United States Patent [19]

Orie, Sr.

[11] 4,445,305

[45] May 1, 1984

[54] INSULATING SECONDARY ROOF SYSTEM

[76] Inventor: Thomas A. Orie, Sr., 3224 Heartwood Ave., Orlando, Fla. 32807

[21] Appl. No.: 424,852

[22] Filed: Sep. 27, 1982

[51] Int. Cl.[3] ..... E04C 1/00; E04B 1/74; E04D 1/00

[52] U.S. Cl. ..... 52/309.9; 52/404; 52/542; 52/521

[58] Field of Search ..... 52/309.8, 443, 444, 52/447, 539, 540, 541, 542, 543, 795, 520, 518, 519, 521, 522, 523, 524, 525, 526, 527, 528, 529, 530, 531, 532, 533, 534, 535, 536, 537, 538, 309.1, 309.2, 309.6, 309.7, 309.9, 309.11, 309.12, 309.16, 583, 72, 200, 173, 224, 171, 172, 403, 404, 407, 410, 553

[56] References Cited

U.S. PATENT DOCUMENTS

| | | | |
|---|---|---|---|
| 390,826 | 10/1888 | Warren et al. | 52/531 |
| 673,613 | 5/1901 | Bennett | 52/531 |
| 978,834 | 12/1910 | Bonness | 52/405 |
| 1,988,201 | 1/1935 | Hall | 52/588 |
| 2,438,099 | 3/1948 | Whitehouse | 52/538 |
| 2,640,669 | 6/1953 | Ashford | 52/588 |
| 3,238,687 | 3/1966 | Tisbo | 52/531 |
| 3,320,711 | 5/1967 | Johnson | 52/553 |
| 3,427,775 | 2/1969 | Bachrich | 52/404 |
| 3,667,185 | 6/1972 | Maurer | 52/537 |
| 4,099,357 | 7/1978 | Lester | 52/537 |
| 4,314,428 | 2/1982 | Bromwell | 52/404 |
| 4,320,605 | 3/1982 | Carlson et al. | 52/410 |

FOREIGN PATENT DOCUMENTS

| | | | |
|---|---|---|---|
| 885722 | 12/1961 | United Kingdom | 52/410 |

*Primary Examiner*—John E. Murtagh
*Assistant Examiner*—Andrew Joseph Rudy
*Attorney, Agent, or Firm*—Duckworth, Allen, Dyer & Pettis

[57] ABSTRACT

A secondary roof system for application over existing metal roofs of the cleat panel or structural panel type. Elongated expanded polystyrene insulation panels are inserted in the roof pans of the existing metal panel roof. A plurality of interlocked secondary metal roof panels having the same width as the original roof panels is disposed over the insulation panels and the interlocking edges attached to the upwardly projecting joints of the existing metal roof panels. A small dead airspace may be provided between the secondary panel faces and the upper faces of the insulation panels.

5 Claims, 2 Drawing Figures

INSULATING SECONDARY ROOF SYSTEM

BACKGROUND OF THE INVENTION

1. Field of the Invention

The present invention relates to an insulating roof structure, and more particularly to a secondary roof system for installing over an existing roof to increase the insulation value thereof.

2. Description of the Prior Art

It has been common practice to construct roofs for porches, screen rooms, patios, mobile homes, storage rooms, workshops, and the like utilizing self-supportive structural roof panels of metal such as aluminum or galvanized steel. This type of roof has little or no insulation value, and the covered area will be hot in the summer and cold in the winter. During hot weather, it is well known that a metal roof will actually increase the interior temperature of a building to a point higher than the ambient temperature due to the heat sink characteristics thereof. It is apparent that insulating this type of a roof will pay great dividends in providing greater comfort to workers in industrial buildings and occupants of residential structures having such metal roofs. Structures such as warehouses and the like will also benefit from insulation applied to the roof in preventing damage to stored goods which may be sensitive to temperature and humidity.

While it is possible to install conventional insulation underneath the roof, this may be an expensive approach since the inside surface of the panels acts as a ceiling. Even if this were done, it does not solve the problem of the heat sink characteristic of the metal roof.

Therefore, there is a need for a low cost, easily installed secondary roof system that can be installed directly over an existing structural panel roof and that will provide sufficient insulation to prevent or minimize gain of heat in the covered area in summer, and, for heated structures, that will prevent loss of heat through the roof in the winter.

SUMMARY OF THE INVENTION

The present invention is a secondary roofing system for installation over an existing metal panel-type roof, such as a cleated panel roof or a structural panel roof. Generally, metal panel roofs have long, narrow panels with turned up edges, which are installed with the turned up edges of each panel contacting the turned up edges of the adjacent panels, thus forming divider-like elements between panels. Generally, the turned up edges are interlocking as in structural panels or have a cap-like covering as in the cleated panels. The cleated panel and structural panel roofs are generally self-supporting with the lower face serving as a ceiling for the covered space. In accordance with the invention, elongated expanded polystyrene insulation panels are inserted between the structural panel divider elements. The thickness of these panels may depend upon the particular space available as defined by the height of the divider elements. After installation of the insulation panels, a plurality of secondary metal panels, which may be of aluminum for example, are installed over the polystyrene insulation panels. The secondary metal panels are about the same width as the original metal roof panels. The edges of the secondary panels of the invention are upturned and interlocking. The faces of the panels may rest on the polystyrene panels or may form a narrow dead airspace.

The formed edge on one side of a secondary metal panel of the invention is adapted to overlap the edge of the adjacent panel. The overlap forms a tight, leakproof fit. The over-lapping edge is secured to the adjacent edge by means of vertical sheet metal screws which thread into the top edge of the existing divider elements as will be shown in more detail below. The overlapped and secured edges of the panels of the invention follow the contours of the original roof panel divider elements. Although not a part of the invention, a metal or plastic trim edge may be provided which will overlap the outer ends of the panels of the invention to give a neat finished look to the secondary roof system, or the ends of panels may be cut to fold down over the insulation panel ends.

Thus, the invention provides a low cost, easily and quickly installed secondary roof system which can be placed over an existing metal roof and which will greatly increase the insulating value of the roof to provide comfort to occupants of the covered space and to maintain a more moderate temperature therein. The secondary roof also strengthens the existing structure, improves the integrity of the roof with respect to leaks, and protects the existing metal panels which form the ceiling of the covered space from damage.

It is therefore a principal object of the invention to provide a secondary roof system installable over a metal roof.

It is another object of the invention to provide a secondary roof system that will add greatly increased insulation value to an existing metal roof, protect the existing panels from damage and add strength to the structure.

It is yet another object of the invention to provide a secondary roof system having a multiplicity of secondary metal panels with interlocking edges, and a multiplicity of expanded polystyrene insulation panels.

It is still another object of the invention to provide a secondary roof system which can be manufactured at low cost and can be quickly installed.

It is a further object to increase the resistance of an existing metal roof to leakage.

These and other objects and advantages of my invention will become apparent from the following detailed description when read in conjunction with the drawings.

DETAILED DESCRIPTION OF THE PREFERRED EMBODIMENT

Figure 1:
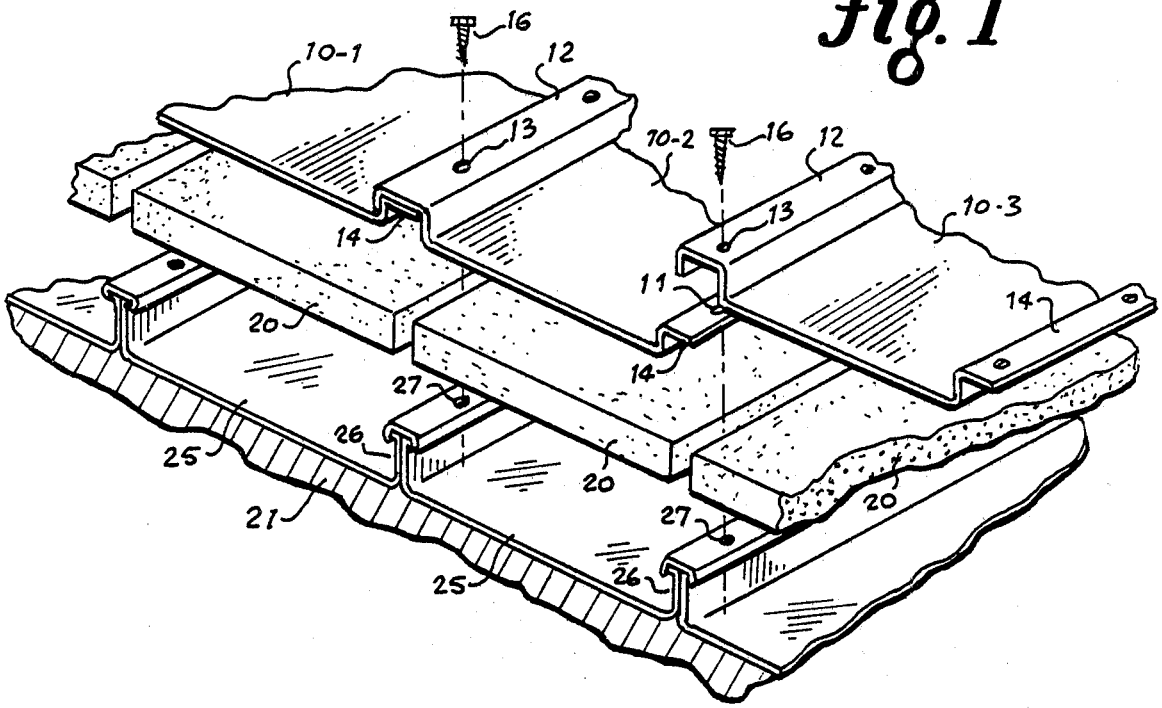
FIG. 1 is a partial perspective exploded view of the secondary roof system of the invention as applied to an existing cleat panel roof.

Referring to FIG. 1, a partial perspective exploded view of the secondary roof system of the invention is shown as applied to a cleat panel roof. Cleat panels 25 having upturned cleated edges 26 from an existing normally self supporting metal roof on a structure 21. In accordance with the invention, expanded polystyrene panels 20 are inserted in the roof pans of panels 25. Generally, existing panels 25 will have a width of about 12 inches while the cleated edges 26 will have a height of about 1¾ inches. Therefore, polystyrene panels 20 may have a thickness of about 1 inch. After insertion of insulating panels 20, secondary roof panels 10 are installed over cleated edges 26 and polystyrene insulating panels 20. A secondary panel 10 has at its right edge an inverted L-shaped portion 14 and at its opposite edge an inverted U-shaped portion 12. For use with the illustrated cleated roof panels 25, the height of portions 14 and 12 of the secondary panels 10 may be about ¾ inch. The edge portion 12 has its inverted U spacing such as to form a tight fit over the adjacent edge 14 as may be seen for secondary panel 10-1 which is shown interlocked with secondary panel 10-2. To secure the secondary panels and the insulating panels 20 to the existing roof, holes 13 are drilled in the overlapping edges 12 and 14 for each secondary panel 10 and matching hole 27 in the cleat portion of cleat edges 26. Holes 13 may be slightly off center as shown. Secondary panel 10-1 is shown in exploded relationship to expose hole 11 aligned with hole 13 and 27 in edge 14 of secondary panel 10-2. Screws 16 which may be of stainless steel are threaded through edge portions 12 and 14 into hole 27 thereby securely joining the secondary panels 10 to the existing roof structure.

By virtue of the tight fit between edge portion 12 of one panel such as 10-2 and edge portion 14 of the adjacent panel such as 10-1, a secure leak-proof joint is formed. Although any suitable metal may be used for the secondary panels 10, aluminum is preferred for its light weight, ease of handling, and low cost.

As may now be understood, secondary panels 10 form an attractive and leak-proof roof surface with expanded polystyrene panels 20 providing insulation. With the exact value depending on the type of building structure, the combination of the secondary roof system of the implementation shown in FIG. 1 and the original roof generally will produce an R-factor of about 7.

Figure 2:
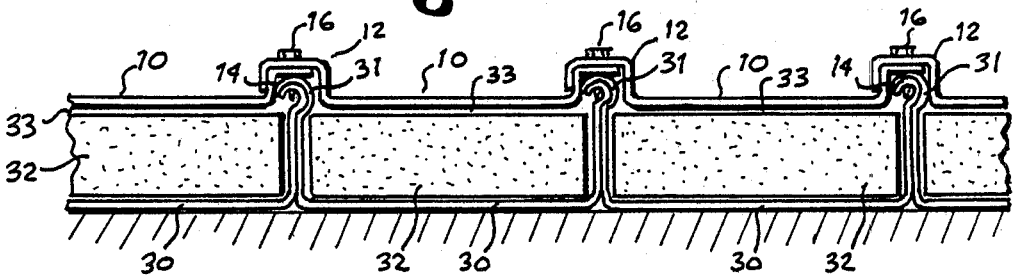
FIG. 2 is an end view of the roof system of the invention applied to an existing 3 inch structural panel roof.

The application of the secondary roof system of the invention to a structural panel roof is shown in FIG. 2. Here, existing 3 inch structural roof panels 30 are installed on a structure 34. Existing stuctural panels 30 have a width of about 12 inches and interlocking joints 31 which project upward 3 inches. This type of existing roof permits use of expanded polystyrene insulating panels 32 of about 2 inches in thickness. As shown in FIG. 2, secondary roof panels 10 have been installed over the polystyrene insulating panels 32 and the original existing structural panels 30. Holes are drilled through the interlocking joints 31 of the existing panels 30 and screws 16 are installed to hold the secondary roof panels 10 in place. Advantageously, the thickness of insulating panels 32 is selected such that there is a small air gap 33 between insulating panels 32 and secondary panels 10. This air gap adds to the insulating value of the system by minimizing convection heat transfer from secondary panels 10 into insulating panels 32. Depending again on the nature of structure 34, the combination of the secondary roof panels and insulating roof panels of the invention with the original roof will produce an R-factor of about 13 for the implementation of FIG. 2.

As may now be recognized, a secondary roof system has been disclosed which is suitable for installing over existing metal roofs of either the cleat panel type or the structural panel type. The system can be quickly installed with a minimum of labor and will provide greatly improved insulation properties and an attractive appearance.

While a specific and preferred embodiment of the invention has been used for illustrative purposes, it will be obvious to those of skill in the art to make various modifications such as in the exact shape of the overlapping portions of the secondary panels, and in the sizes and materials used without departing from the spirit and scope of the invention.

I claim:

1. An insulative secondary roof system for installation over an existing metal roof having a plurality of structural roof panels, each panel having an elongate rectangular flat portion, the flat portion having an upturned edge along each longitudinal side thereof, the upturned edge being contiguous with an upturned edge of an adjacent panel and joined thereto, whereby each panel forms a rectangular channel, the secondary roof system comprising:

a plurality of elongate, rectangular insulating panels, each of said insulating panels having a width approximately equal to the width of the existing roof channel and a thickness approximately equal to the depth of the channel, said insulating panels disposed in the existing roof panels in total contact with the flat portion of the roof panels;

a plurality of elongate, rectangular secondary metal panels, one of said metal panels disposed over each of said insulation panels, each of said secondary metal panels having upturned edges, one of said edges having an inverted L-shaped portion and the other edge having an inverted U-shaped portion, said U-shaped portion of each of said secondary panels formed to fit over said L-shaped portion of its adjacent one of said secondary panels to thereby interlock with each other, said inverted U-shaped portion adapted to fit over and to contact the joints of said existing metal panels; and a plurality of screws driven through said inverted U-shaped portions, said inverted L-shaped portions, and said existing metal panel joints for securing said secondary panels to said existing roof structure.

2. The system as defined in claim 1 in which the lower face of each of said secondary panels is in total contact with the upper face of said insulating panel adjacent thereto.

3. The system as defined in claim 1 in which said insulating panels are formed from expanded polystyrene.

4. The system as defined in claim 1 in which said secondary metal panels are formed from aluminum.

5. The system as defined in claim 1 which further comprises an insulating airspace defined by the lower face of each of said secondary panels and the upper face of said insulating panel adjacent thereto.

* * * * *